US010414161B2

(12) United States Patent
Ormaechea et al.

(10) Patent No.: US 10,414,161 B2
(45) Date of Patent: Sep. 17, 2019

(54) PRINTER HAVING CONDUIT GRIP AND METHOD OF GRIPPING CONDUIT

(71) Applicant: HEWLETT-PACKARD DEVELOPMENT COMPANY, L.P., Houston, TX (US)

(72) Inventors: Joseba Ormaechea, Sant Cugat del Valles (ES); Martin Urrutia, Sant Cugat del Valles (ES); Inigo Oraa, Guecho (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/542,489

(22) PCT Filed: Jan. 30, 2015

(86) PCT No.: PCT/EP2015/052013
§ 371 (c)(1),
(2) Date: Jul. 10, 2017

(87) PCT Pub. No.: WO2016/119903
PCT Pub. Date: Aug. 4, 2016

(65) Prior Publication Data

US 2018/0281420 A1 Oct. 4, 2018

(51) Int. Cl.

| | |
|---|---|
| ***B41J 2/175*** | (2006.01) |
| ***B41J 19/00*** | (2006.01) |
| ***B41J 25/34*** | (2006.01) |
| ***B41J 29/13*** | (2006.01) |
| ***B41J 29/02*** | (2006.01) |

(52) U.S. Cl.
CPC ..... *B41J 2/175* (2013.01); *B41J 19/005* (2013.01); *B41J 25/34* (2013.01); *B41J 29/02* (2013.01); *B41J 29/13* (2013.01)

(58) Field of Classification Search
CPC ... B41J 2/175; B41J 29/02; B41J 29/13; B41J 19/005; B41J 25/34
See application file for complete search history.

(56) References Cited

U.S. PATENT DOCUMENTS

| | | | |
|---|---|---|---|
| 6,206,512 | B1 | 3/2001 | Gasso et al. |
| 6,367,918 | B1 | 4/2002 | Heiles et al. |
| 7,775,629 | B2 | 8/2010 | Nukui et al. |
| 7,954,937 | B2 | 6/2011 | Inamura et al. |
| 2008/0111869 | A1 | 5/2008 | Kumagi et al. |
| 2014/0043392 | A1 | 2/2014 | Suzuki et al. |
| 2014/0098166 | A1 | 4/2014 | Suzuki et al. |
| 2016/0215901 | A1* | 7/2016 | Takeuchi ..... G02B 6/4461 |

FOREIGN PATENT DOCUMENTS

JP 402004561 A 9/1990

* cited by examiner

*Primary Examiner* — Justin Seo
(74) *Attorney, Agent, or Firm* — HP Inc. Patent Department

(57) ABSTRACT

A printer, comprising a moveable carriage having at least one print head mounted thereon; and at least one flexible conduit connected at a first end to the carriage. An intermediate portion of the conduit is supported in a guide allowing the conduit to follow reciprocating movement of the carriage across a print zone of the printer. A retainer is moveable between first and second positions. In the first position the retainer permits the conduit to follow the movement of the carriage. In the second position the retainer is arranged to grip the conduit at a location between the intermediate portion and the first end.

15 Claims, 5 Drawing Sheets

PRINTER HAVING CONDUIT GRIP AND METHOD OF GRIPPING CONDUIT

BACKGROUND

A printer often includes a moving carriage having components thereon such as print heads which are connected by one or more flexible conduits to a body of the printer. The conduits may comprise ink tubes and/or electrical connections. In use when the carriage is moving across a print media the conduits follow movement of the carriage.

However when it is desired to perform operations on the printer involving disconnection of the one or more conduits from components mounted upon the carriage, such as a maintenance operation, the conduits may be incorrectly positioned subsequent to the operation, which may cause damage to the conduits from moving parts or movement of the conduits against stationary parts e.g. the conduits may contact parts of the printer with movement there-between causing wear to the conduits.

It is an object of embodiments of the invention to at least mitigate one or more of the problems of the prior art.

BRIEF DESCRIPTION OF THE DRAWINGS

Embodiments of the invention will now be described by way of example only, with reference to the accompanying figures, in which.

DETAILED DESCRIPTION OF EMBODIMENTS OF THE INVENTION

Figure 1:
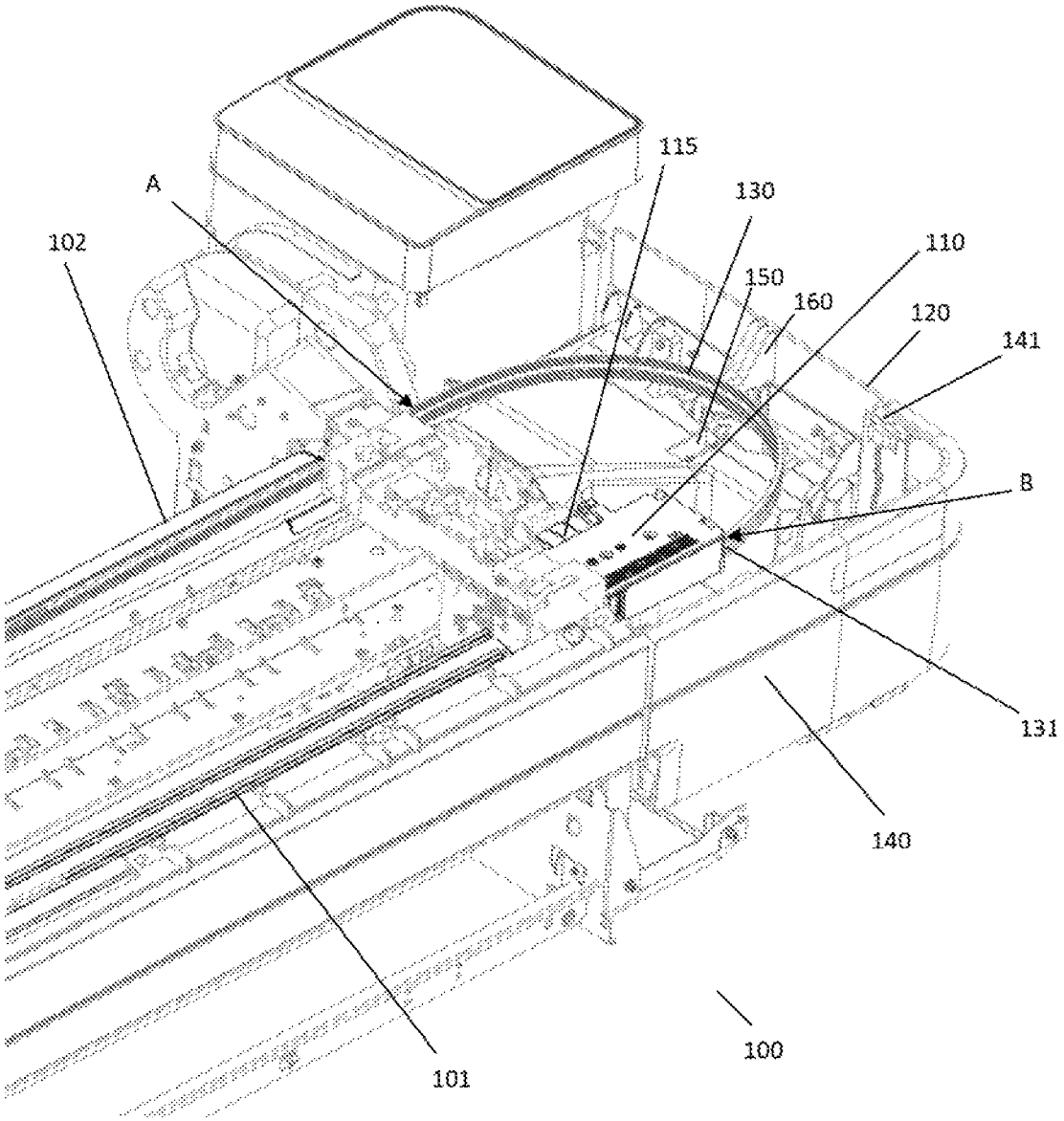
FIG. 1 shows a portion of a printer according to an embodiment of the invention.

FIG. 1 shows a portion of a printer 100, which may be an inkjet printer. The printer comprises a carriage (the top part of which has been omitted from FIG. 1 for clarity) upon which is mounted a print head interconnection 110, The carriage is transversely moveable over a print area or platen for printing on a print media. The carriage is arranged to move along at least one guide 101, 102, such as a rail, disposed perpendicular to a direction in which the print media, such as paper, is fed. In use the carriage moves in a reciprocating manner along the one or more guides 101, 102. By way of example FIG. 1 shows two guides 101, 102, a front guide 101 and a rear guide 102. At least at one end of the printer the one or more guides 101, 102 extend beyond the print area. The carriage is arranged to move along the one or more guides 101, 102 beyond a maximum lateral extent of the print area, such that the print head interconnection 110 becomes at least partially enclosed by a housing 120 of the printer 100 (shown in FIG. 1 with an upper portion of the housing 120 removed). The housing 120 is disposed at an end of the one or more guides 101, 102 to a side of the print area.

One or more print heads 115 are carried upon the carriage. In some embodiments a plurality of print heads 115 are mounted upon the carriage and connected to the print head interconnection 110, where each of the print heads 115 is arranged to print on the print media a corresponding colour such as one of CMYK. In order to operate, the print head interconnection 110 mounted upon the carriage is coupled to the printer 100 by one or more flexible conduits 130. As shown in FIG. 1 in some embodiments a plurality of conduits 130 are coupled to the interconnection 110. An end 131 of the conduits 130 is connected to the interconnection 110. The conduits may comprise one or more of hollow conduits for providing ink to the print heads 115 and electrical connections to the print heads 115, interconnection 110, and/or carriage.

The conduits 130 are arranged to allow the carriage to move along the one or more guides 101, 102 across the print media. In particular the conduits 130 have a slack portion for allowing the conduits 130 to follow the movement of the carriage. The guides 101, 102 are arranged parallel to each other and at least one of the guides 101, 102 supports the conduits 130. In FIG. 1 the rear guide 102 supports the conduits 130, however in other embodiments it may be arranged such that the front guide 101 supports the conduit 130. The one or more guides 101 may comprise a generally U-shaped channel in which the conduits 130 are arranged to run parallel to the channel. When viewed in plan view, the conduits 130 are arranged in a U-shape where the conduits 130 exit from the guides 101, 102 and change to run in an opposed direction where the conduits 130 connect at their end 131 to the interconnection 110. When the carriage moves along the print head guide 101 across the print media away from the housing 120 the conduits 130 follow the movement of the carriage by leaving the rear guide 102 at an earlier point along its length. In the arrangement shown in FIG. 1, the conduits 130 exit from an end of the rear guide 102 proximal to the housing 120 such that the U-shaped curve of the conduits 130 is within the housing 120. It will also be appreciated that a guide may be arranged at the front of the printer 110. The guide is provided for supporting the conduits 130 proximal to the carriage particularly as the carriage moves across the print area distal from the housing 120.

Figure 2:
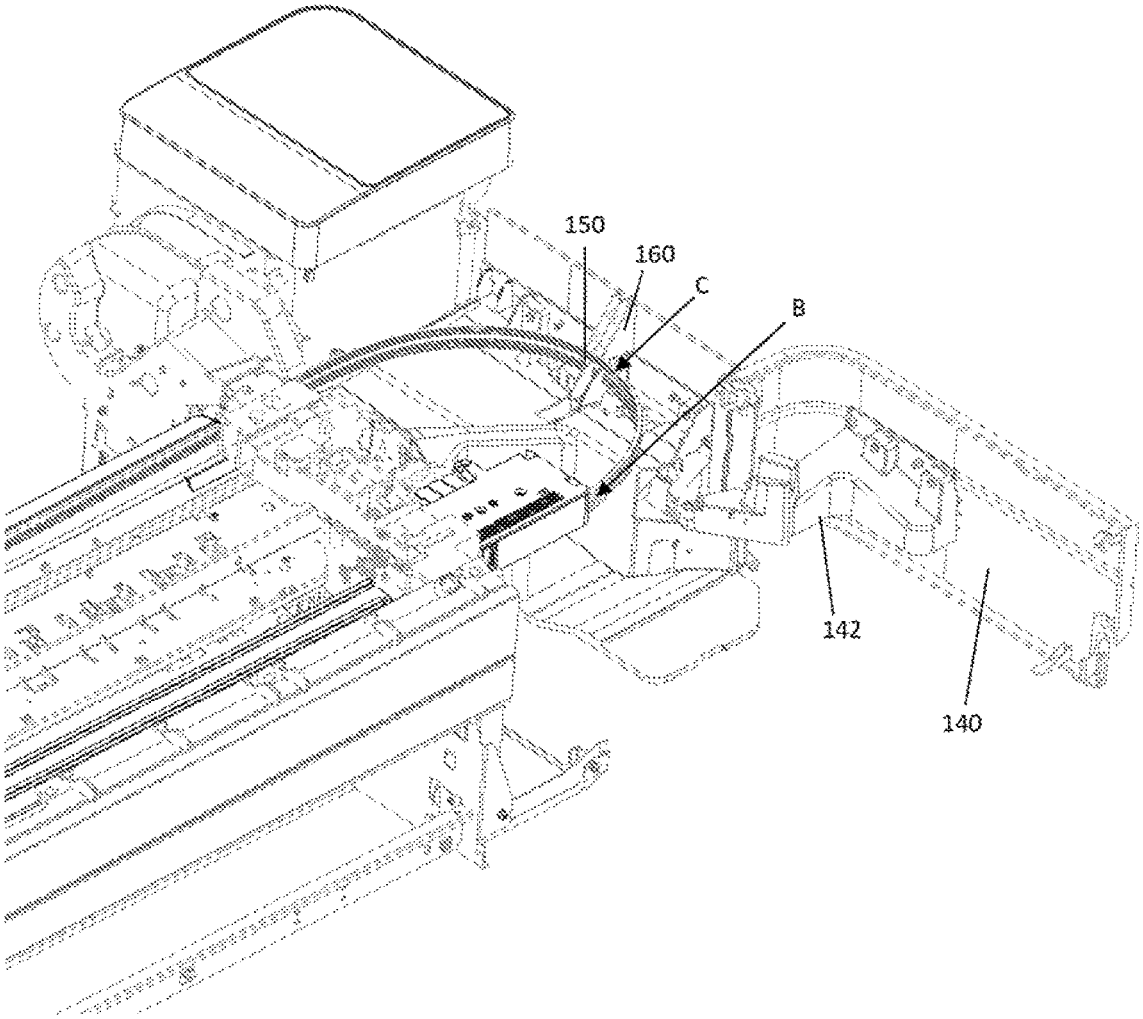
FIG. 2 shows the portion of a printer having an open cover according to an embodiment of the invention.

A cover 140 is provided in the housing 120 to permit access to the carriage and interconnection 110. In order to perform a maintenance operation, such as although not exclusively removing or adjusting the print heads 115, when the carriage is located in the housing 120 the cover 140 is opened by a user to allow access to the carriage and interconnection 110. The cover 140 in the embodiment shown in FIG. 1 is a door 140 mounted upon a hinge 141. The door 140 forms a front portion of the housing 120 for allowing access to a front region of the housing 120. The hinge 141 is provided at side edge of the door 140, although in other examples the hinge may be arranged at other edges of the door 140. The hinge rotatably connects the door 140 to a side-wall of the housing 120. Thus the door 140 may be rotated to an open position by the user, such that the door 140 is arranged in the open position as shown in FIG. 2. When so opened the user may access the carriage and interconnection 110 as shown in FIG. 2. As part of the maintenance operation it may be desired to uncouple the conduits 130 from the print head 115 by disconnecting the interconnection 110 and conduits 130.

The printer 100 comprises a moveable retainer 150 for gripping the conduits 130 at a location between the intermediate portion, where the conduits 130 are supported by one of the guides 101, 102, and the first end where the conduits 130 connect to the interconnection 110. The retainer 150 is moveable between first and second positions. The retainer 150 is in the first position in FIG. 1 wherein the retainer 150 is arranged to permit the conduits 130 to follow the movement of the carriage. That is, when the retainer 150 is in the first position the U-shaped curvature of the conduits 130 is able to move away from the housing 120 to follow the movement of the carriage along the carriage guide 101 distal from the housing 120. In the second position the retainer 150 is arranged to grip the conduits 130 at a location between the intermediate portion and the first end 131 thereby preventing the conduits 130 substantially moving. As shown in FIG. 1, with the retainer 150 in the first position a length of conduit between points A and B is free to move. However with the retainer 150 in the second position as shown in FIG. 2 only a length of conduit between points B and C is free to move where A-B is substantially longer than C-B. In one embodiment C-B is approximately half of length A-B, although it will be realised that other ratios of length may be envisaged.

Figure 3:
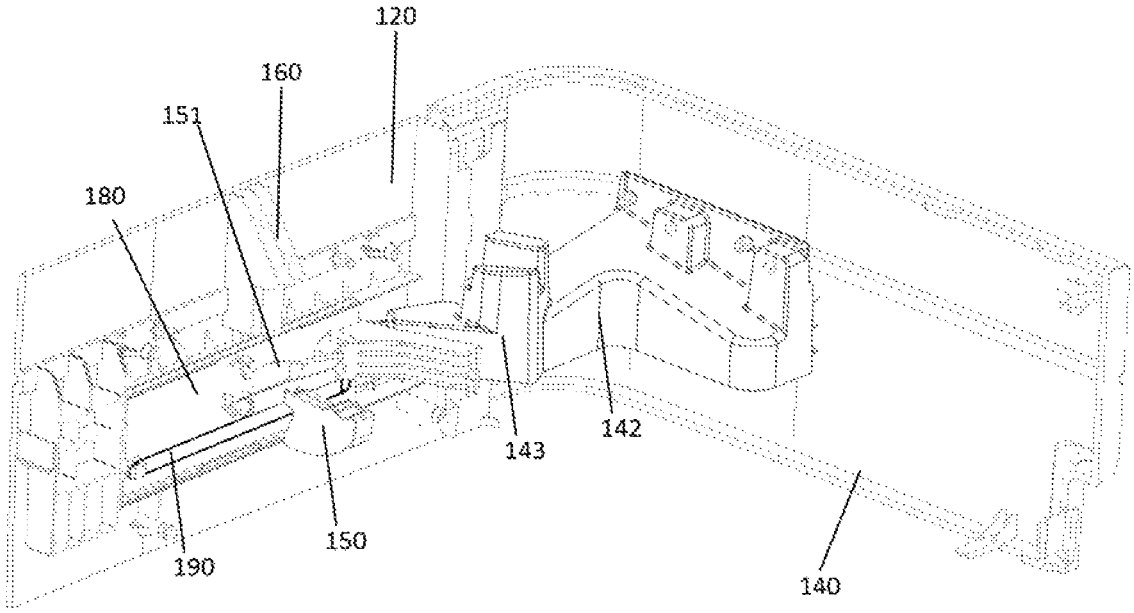
FIG. 3 shows an interior view of the portion of the printer having the cover in a closed position according to an embodiment of the invention.
Figure 4:
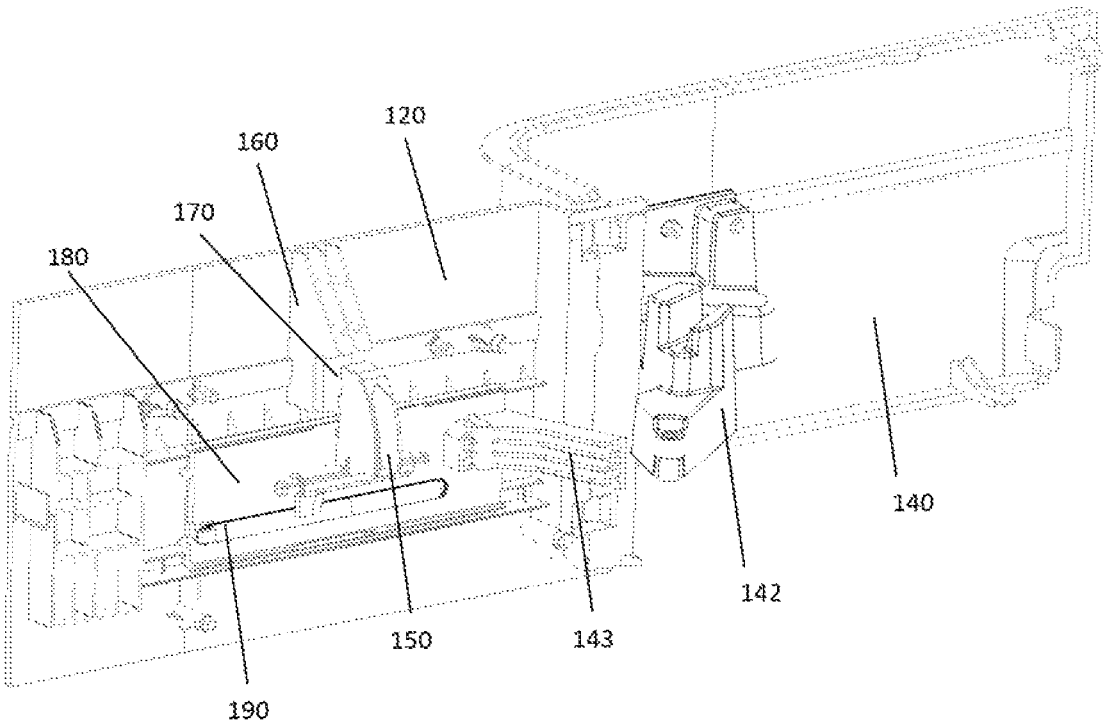
FIG. 4 shows an interior view of the portion of the printer having the cover in an open position according to an embodiment of the invention.

FIGS. 3 and 4 show an interior view of the housing 120 with the door 140 in closed and open positions respectively. Figure S shows a close up view of the mechanism used to rotate the retainer 150. As can be appreciated, in FIG. 3 the retainer 150 is in the first position permitting movement of the conduits (not shown in FIGS. 3 and 4) whereas in FIG. 4 the retainer 150 is in the second position arranged to grip the conduits 130. The door 140 is connected to the retainer 150 such that movement of the door 140 is arranged to cause the retainer 150 to correspondingly move between the first and second positions in response to the door 140 moving between the open position and the closed position. In particular the retainer 150 is connected to the door 140 such that the retainer 150 is in the first position when the door 140 is in the closed position, as shown in FIGS. 1 and 3, and the retainer 150 is in the second position when the door 140 is in the open position as shown in FIGS. 2 and 4.

Figure 5:
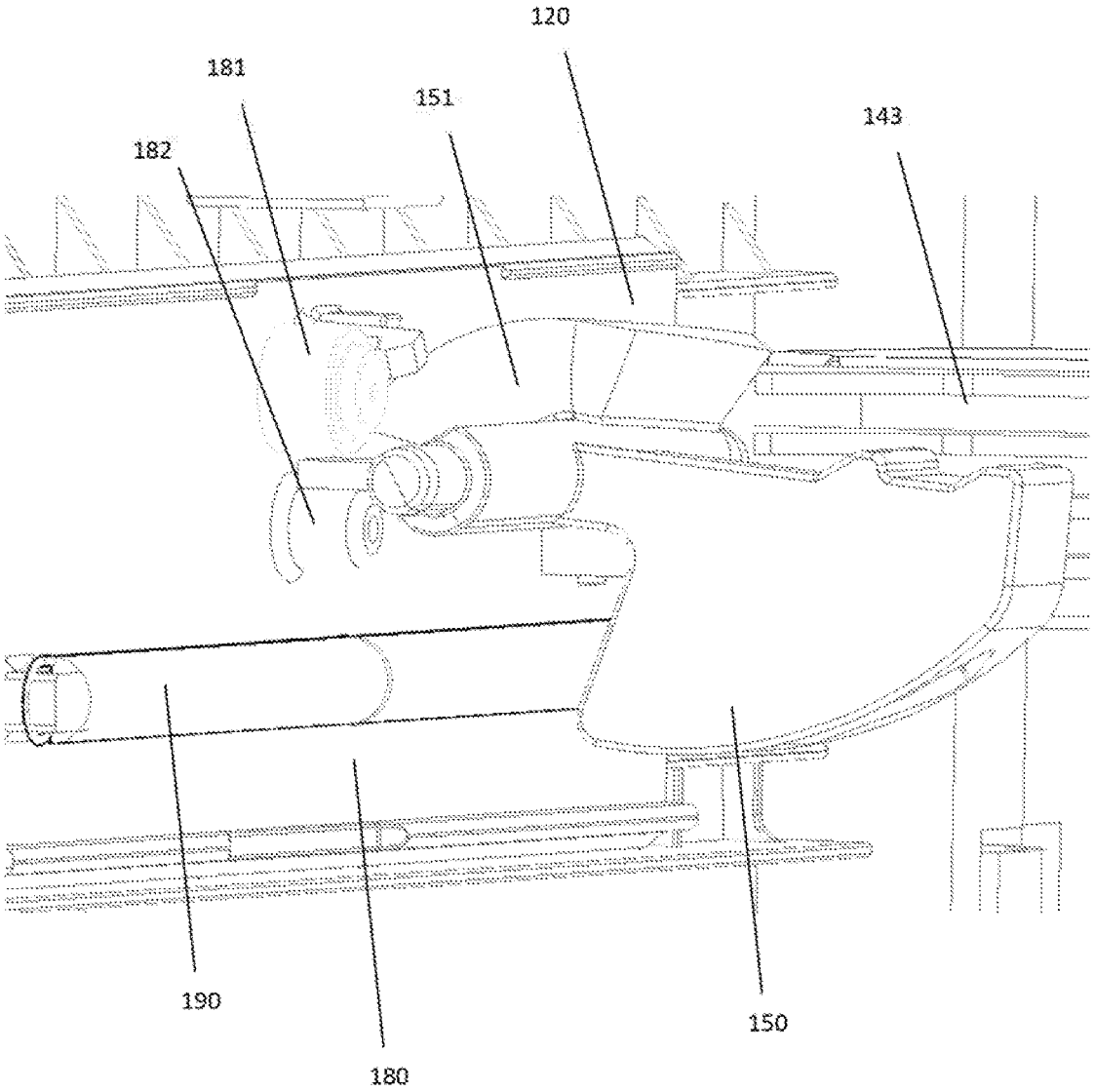
FIG. 5 shows a close up view of an embodiment of a retainer rotation mechanism according to an embodiment of the invention.

Mounted upon an interior surface of the door 140 is an arm 142. This arm 142 contacts a pusher 143 when the door is in the closed position. As shown in FIGS. 3, 4 and 5, the pusher 143 is connected to a slider 180 attached to a spring 190 which is placed under tension when the door 140 is closed. As the door 140 is opened, the slider 180 moves in the direction of the spring 190 along guiding elements in the housing 120 (not shown in the figures for clarity). As the slider 180 moves, the linear movement is transferred to the retainer 150. The movement is transferred to the retainer 150 by two pins 181, 182 mounted upon the slider 180. The pins 181, 182 act upon a helical shaped portion 151 of the retainer 150, forcing the retainer 150 to rotate to grip the conduits 130.

The helical shaped portion 151 of the retainer 150 changes the linear movement of the slider 180 into a rotation of the retainer 150. The lower portion of the retainer 150 comprises an aperture for rotatably mounting upon an axle. The slider 180 and retainer 150 are mounted such that the retainer 150 pivots between the first and second positions in response to the door 140 moving between the open position and the closed position, by virtue of the closing of the door 140 forcing the spring 190 to be placed under tension. The spring biases the slider 180 to the open position and therefore the retainer 150 to the second upward position. It will be realised that in other embodiments the retainer may be arranged to move in another manner, such as to slide between the first and second positions. In the first position in the embodiment shown in the figures the retainer 150 is arranged to extend generally horizontally to allow the conduits 130 to move away from the side-wall of the housing 120 in response to movement of the carriage. In the second position the retainer 150 is arranged to extend generally upwardly to retain the conduits 130. The conduits 130 are retained in a fixed position in relation to the housing 120, particularly in relation to the side-wall of the housing 120.

The printer comprises a gripping member 160 which is arranged to act in co-operation with the retainer 150 to retain the conduits 130 in the second position of the retainer. The gripping member 160 is arranged at an opposing side of the conduits 130 to the retainer 150. In the embodiment shown in FIGS. 1-4 the gripping member 160 is a protrusion on the interior surface of the housing 120, in particular the interior surface of the side-wall 120. It will be realised, however, that the gripping member 160 may be arranged in other locations to act against the retainer 150.

The gripping member 160 is shaped and located to form an aperture between the gripping member 160 and the retainer 150 when in the second position. The gripping member 160 in the illustrated embodiments has a portion forming an inverted L-shaped aperture. As particularly shown in FIG. 4, when the retainer 150 is in the second position, an end of the retainer 150 distal from the aperture containing the axle is arranged to be in close proximity to the gripping member 160 such that the conduit 130 is retained there-between. An aperture exists between the body of the retainer 150 and the gripping member 160 for allowing the conduits 130 to pass there-through whilst retaining the conduits 130 in a fixed position. At a point 170 where the retainer 150 comes into contact with the conduits 130 there may be a resiliently deformable piece of material, such as foam, to prevent damage to the conduits 130.

The gripping of the conduits 130 when performing maintenance and/or other tasks requiring the disconnection of the conduits 130 from the print head interconnection 140, may result in reducing or removing the need for a skilled engineer to undertake the work, thereby reducing the costs and time required to repair the printer. The gripping of the conduits 130 may also ensure the conduits 130 do not get damaged and/or misplaced during these tasks.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A printer, comprising:

a moveable carriage having at least one print head mounted thereon;

at least one flexible conduit connected at a first end to the carriage, wherein an intermediate portion of the conduit is supported in a guide to allow the conduit to follow reciprocating movement of the carriage across a print zone of the printer; and a retainer moveable between first and second positions, wherein in the first position the retainer permits the conduit to follow the movement of the carriage and, in the second position, the retainer is arranged to grip the conduit at a location between the intermediate portion and the first end to permit movement of the conduit between the location and the first end and to restrict movement of the conduit between the guide and the location.

2. The printer of claim 1, comprising a cover arranged to permit access to the carriage, wherein the retainer is connected to the cover to move between the first and second positions responsive to opening and closing of the cover.

3. The printer of claim 2, wherein the retainer is connected to the cover such that the retainer is in the first position when the cover is in a closed position, and the retainer is in the second position when the cover is in the open position.

4. The printer of claim 2, wherein the cover is a door mounted upon a hinge to move between an open position and a closed position and the retainer is connected to the door by a mechanism arranged to cause the retainer to pivot between the first and second positions in response to the door moving between the open position and the closed position.

5. The printer of claim 1, wherein the retainer is arranged at a first side of the printer to grip the conduit when the carriage is at the first side of the printer.

6. The printer of claim 1, wherein the retainer is arranged to grip the conduit at a generally middle location of a U-shaped portion between the guide and the first end.

7. The printer of claim 1, comprising a pad of a resiliently deformable material arranged upon a portion of the retainer preventing damage to the conduit.

8. The retainer of claim 7 wherein the pad of the resiliently deformable material is foam.

9. The printer of claim 1, comprising a slider arranged to move laterally along one or more guides in response to the opening and closing of a cover for accessing the carriage, wherein the retainer is arranged to rotate between the first and second positions in response to the movement of the slider.

10. The retainer of claim 9, wherein the rotational movement is achieved by a helical portion of the retainer being acted upon by one or more pins attached to the slider.

11. A method of securing a conduit in a printer, comprising:

supporting an intermediate portion of at least one flexible conduit in a guide, wherein a first end of the conduit is connected to a moveable carriage, such that the conduit follows reciprocating movement of the carriage across a print zone of the printer, and wherein the moveable carriage is to move along the guide; and moving a retainer between a first and second positions, wherein the first position allows the conduit to follow the movement of the carriage and the second position grips the conduit at a location between the intermediate portion and the first end.

12. The method of claim 11 wherein the retainer moves between the first and second position responsive to opening of a cover of a housing.

13. The method of claim 11 wherein the retainer is arranged to rotatably move to the second position.

14. The method of claim 12 wherein the opening of the cover is arranged to cause linear movement of a slider, wherein the linear movement of the slider causes the retainer to rotatably move between the first and second position.

15. The method of claim 14, comprising translating the linear movement of the slider to the rotational movement of the retainer by a helical portion of the retainer which is acted upon by at least one pin attached to the slider.

* * * * *